United States Patent [19]

Braun et al.

[11] 4,395,282

[45] Jul. 26, 1983

[54] DESULFURIZATION MIXTURE AND PROCESS FOR MAKING IT

[75] Inventors: Albert Braun, Hürth; Willi Portz; Georg Strauss, both of Erftstadt; Hans-Martin Delhey, Duisburg, all of Fed. Rep. of Germany

[73] Assignee: Hoechst Aktiengesellschaft, Fed. Rep. of Germany

[21] Appl. No.: 359,228

[22] Filed: Mar. 18, 1982

[30] Foreign Application Priority Data

Mar. 24, 1981 [DE] Fed. Rep. of Germany ..... 3111510

[51] Int. Cl.[3] ..... C22C 7/02

[52] U.S. Cl. ..... 75/58; 75/53; 75/257

[58] Field of Search ..... 75/53, 55, 58

[56] References Cited

U.S. PATENT DOCUMENTS

| | | | |
|---|---|---|---|
| 3,197,306 | 7/1965 | Osborn | 75/53 |
| 3,314,782 | 4/1967 | Arnaud | 75/58 |
| 3,598,573 | 8/1971 | Freissmuth | 75/53 |
| 3,884,679 | 5/1975 | Mitteldorf | 75/53 |

*Primary Examiner*—P. D. Rosenberg

*Attorney, Agent, or Firm*—Connolly and Hutz

[57] ABSTRACT

The disclosure provides mixtures for the desulfurization of metal melts, especially steel and crude iron melts, based on $CaC_2$—CaO-crystal blends produced in the fused mass. More specifically, the mixtures contain free carbon and carbonate and have a portion of the CaO in the $CaC_2$—CaO-crystal blend hydrated to $Ca(OH)_2$. The disclosure also relates to a process for making the mixtures.

9 Claims, No Drawings

DESULFURIZATION MIXTURE AND PROCESS FOR MAKING IT

The present invention provides a mixture for desulfurizing metal melts, especially steel and crude iron melts, the mixture being based on $CaC_2$—CaO-crystal blends produced in the fused mass, and also provides a process for making the mixture.

It has already been described (DE-OS No. 29 07 069) that metal melts, especially crude iron and steel melts, can be desulfurized by means of an agent on basis $CaC_2$/CaO consisting of a $CaC_2$/CaO-crystal blend initially produced in the fused mass and subsequently crushed, the blend containing 35 to 65 weight % $CaC_2$, based on the $CaC_2$/CaO-quantity. It has also been described (DE-AS No. 22 52 795) that metal melts can be desulfurized with the use of commercial carbide (about 80 weight % $CaC_2$, the balance being CaO) or with the use of mixtures thereof with carbon and gas-yielding materials, e.g. $Ca(OH)_2$. In order to enable effective use to be made of the desulfurizing agents described heretofore, it has been necessary for them to be ground to fine material, especially for use in submerged lance processes. Although these agents comply with the necessary specification, they are expensive as regards manufacture and use, inasmuch as it is invariably necessary even for the finely ground desulfurizing agents to be used in relatively large quantities in order to achieve the targeted degree of desulfurization.

It is therefore an object of the present invention to provide a desulfurizing agent of improved efficiency and a process for making it under commercially attractive conditions.

To this end, the invention provides for the mixture to contain free carbon and carbonate and for a portion of the CaO in the $CaC_2$—CaO-crystal blend to be hydrated to form $Ca(OH)_2$. A preferred feature provides for the feed material to be selected from $CaC_2$—CaO-crystal blends containing 40 to 80 weight % CaO (corresponding to 20 to 60 weight % $CaC_2$), especially 45 to 80 weight % CaO (corresponding to 20 to 55 weight % $CaC_2$) or 40 to 65 weight % CaO (corresponding to 35 to 60 weight % $CaC_2$). A further preferred feature provides for the mixture to contain 1 to 6 weight % $H_2O$, preferably 2.5 to 3.5 weight % $H_2O$, chemically combined with calcium oxide. A still further preferred feature provides for the mixture to contain the $CaC_2$—CaO-crystal blend produced in the fused mass together with 0.5 to 8 weight % free carbon (coke breeze, anthracite, graphite, carbon black and 0.5 to 20 weight % calcium carbonate, magnesium carbonate, sodium carbonate).

On being allowed to solidify, CaO and $CaC_2$ crystallize out of the fused mass in the form of a crystal blend in which the $CaC_2$ and CaO crystals have grown into one another; in the event of $CaC_2$ and CaO having been used in the quantitative ratio specified, the blend has a composition lying in the region of the eutectic or has a sub-eutectic composition displaced towards the lime side. Upon the addition of $H_2O$ a portion of the CaO in the crystal blend undergoes reaction in accordance with the following equation:

$$CaO + H_2O \rightarrow Ca(OH)_2$$

without the $CaC_2$ that has grown into the CaO crystals being significantly attacked by the $H_2O$.

Upon the introduction of such desulfurizing agent into a metal melt, the ground particles thereof, consisting of CaO—$CaC_2$ crystal intergrowths in which a portion of the CaO crystals is hydrated, become decomposed at temperatures of above 800° C. according to the following reaction equation:

$$CaC_2 + Ca(OH)_2 \rightarrow 2CaO + 2C + H_2$$

The gas which is being evolved at the reactive interfaces of the crystals, makes the ground particles disintegrate regularly, liberating lime highly-reactive in statu nascendi and increasing the surface area of the CaO—$CaC_2$ intergrowth crystals. The amount eutectic crystal structure results in a reaction surface area of ideal size. The liberated gases, which have a reducing action, provide ideal conditions for reacting the CaO with the sulfur dissolved in the metal melt.

Such desulfurizing mixture is extremely well suitable in desulfurization processes wherein a minimum of time is available for reaction of the desulfurizing agent with the sulfur. Among these processes is the submerged lance process wherein it is necessary for the desulfurizing mixtures, which are injected into a metal melt below the surface of the latter, to react as completely as possible during the short time between the introduction (into the melt) of the mixtures and their ascending to the surface of the bath.

The desulfurization efficiency of the mixture of this invention compares favorably with that of the best known carbide-based mixtures. As a result of the intercrystalline gas reaction in the ground particles, the reaction of $CaC_2$ to form CaO and the resulting increase in the size of the crystals' surface area is more effective, the evolution of gas is more uniform and less violent than in the case of known desulfurizing mixtures, for example such as those described in DE-AS No. 22 52 795, which have gas-yielding additives mechanically intermixed therewith. The desulfurization therefore takes place more smoothly and with less metal ejection, especially in the open ladle and the torpedo ladle. As a result of the higher reactivity of the desulfurizing mixture of this invention, which originates from the increase the crystal surface areas undergo upon the disintegration of the ground particles in the melt, it is possible for it to be used in the form of relatively coarse particles, which need not be subjected to expensive fine grinding treatment.

The homogeneous composition of the desulfurizing mixture of this invention results in the end content desired in each particular case to be established with greater reliability. In addition to this, the present agent can be produced with considerably less expense than known carbide-based agents.

The invention also relates to a process for the manufacture of the present mixture, which provides for finely divided calcium oxide to be introduced in an excess of from 3 to 15% by weight, based on the quantity desired in the $CaC_2$—CaO crystal blend, into a customary previously prepared calcium carbide melt which already has up to 45% by weight of calcium oxide therein; for the resulting mixture to be then cooled to temperatures of 350° to 450° C. to cause solidification; for the solidified mixture to be rough-crushed at these temperatures to particles with a size of less than 150 mm; for invariably obtained particles with a size smaller than 4 mm to be separated from coarser material; for the latter to be admixed with free carbon and carbonate; and for the mixture to be comminuted in the presence of air or nitrogen with a moisture content of 5 to 20 g/m$^3$ (at 1.013 bar and 273.15 K.) by crushing and grinding at temperatures lower than 100° C., preferably at 10° to 50° C., to produce particles with a size of less than 10 mm, preferably less than 0.1 mm.

Further preferred features of the present process provide:

(a) for the carbide to be rendered lean by admixing it with the calcium oxide in a crucible with utilisation of the heat content of the carbide;

(b) for the calcium oxide, which is to be added to the calcium carbide melt, to be pre-heated to temperatures of up to 2000° C. and for it to be introduced into the melt while hot, the calcium oxide being pre-heated to temperatures which are the higher, the higher the proportion of additionally dissolved calcium oxide desired, within the range 40 to 80 weight %;

(c) for a calcium carbide melt containing between 20 and 45 weight % calcium oxide to be used as feed material; and (d) for the fraction of particles with a size smaller than 4 mm, sieved off after the rough crushing step, to be recycled into the process.

In those cases in which the calcium oxide that is added to the melt is previously pre-heated to temperatures of up to 2000° C., preferably of up to 1100° C., and, at these temperatures, is introduced into the melt while hot, it is possible to increase the CaO content in the carbide to up to 80 weight %, the calcium oxide being pre-heated to temperatures which are the higher, the higher the proportion of additionally dissolved calcium oxide desired, within the range 40 to 80% by weight. As a result, use can be made of the desulfurizing mixture in low-carbon crude iron and steel melts and the desulfurizatin yield, based on calcium carbide, is increased.

The fraction of particles with a size smaller than 4 mm, which is sieved off after the rough crushing step, consists substantially of CaO. This finely divided calcium oxide should be recycled into the process and used together with fresh CaO as feed material therein. Needless to say, the artisan would not have expected the step of sieving off the fraction of particles with a size smaller than 4 mm, which are formed after the rough crushing, and which have no or only a slight desulfurization efficiency, would result in the efficiency of the final product being so considerably increased.

The product made in accordance with this invention is considerably easier to grind than products obtained by prior processes. This is of special importance inasmuch as the product is sometimes required to be used in the form of particles with a size of less than 0.1 mm.

The following Examples illustrate the invention:

EXAMPLE 1

Calcium carbide was made from lime and coke in customary manner, for example electrothermally, the lime/coke mixture in the charge being set at a ratio by weight of 100:40, corresponding to a carbide having a CaO content of approximately 40 weight %. CaO with a particle size of 3 to 8 mm and a $Ca(OH)_2$ content and $CaCO_3$ content of less than 1 weight %, respectively, was added to a stream of molten carbide tapped off the furnace into a crucible at such a rate and in such quantities that by the time the crucible was full the total ratio by weight $CaC_2$:CaO was 43:57, corresponding to an excess of 14 weight % CaO, based on the CaO content of 50 weight % desired for the final product. Next, the product was cooled until the average temperature of the solidified carbide block was about 400° C., and the block was rough-crushed to material of less than 150 mm in size.

The fraction of particles smaller than 4 mm, which were formed during rough crushing, contained substantially the CaO in excess, while the remaining product consisting of particles with a size of more than 4 mm was a crystal blend of 50 weight % $CaC_2$ and 50 weight % CaO.

850 kg of this $CaC_2$—CaO-crystal blend was mixed with 100 kg limestone (particles smaller than 1 mm) and 50 kg coke breeze (particles smaller than 3 mm) and the whole was ground at 50° C. in a rotary mill with a throughput of 500 kg/h, while passing through 1500 m$^3$/h of air with a moisture content of 10 g/m$^3$ (at 15° C.), to particles with a size of less than 0.1 mm. The particle fraction smaller than 4 mm sieved off was reused together with fresh lime (CaO), as feed material. The resulting product contained 2 weight % chemically combined water.

1500 kg of this product was injected into a 300 t crude iron melt having a sulfur content of 0.03 weight % at a temperature of 1400° C., and the sulfur content of the iron melt was reduced to less than 0.005 weight %.

EXAMPLE 2

The procedure was as in Example 1 except that the CaO was pre-heated to a temperature of about 1100° C. prior to introducing it into the melt, and the quantity of CaO was increased so as to have a total CaO content in the crucible of 62.5 weight %, corresponding to an excess of 4 weight %, based on the CaO content of 60 weight % desired for the final product.

1800 kg of the product, worked up and ground according to the invention, were used for the desulfurization of a 300 t steel melt having a sulfur content of 0.02 weight % at 1650° C. The sulfur content of the melt was reduced to less than 0.005 weight %.

EXAMPLE 3

(a) A 300 t crude iron melt having the following analysis (weight %):

4.5% carbon, 0.8% silicon, 0.7% manganese, 0.08% phosphorus, 0.064% sulfur and the balance iron, was desulfurized by the submerged lance process in an open ladle with the use of the desulfurizing mixture of Example 1. The submersion depth of the lance was 1.8 m. The injection rate was 100 kg/min. The total consumption of desulfurizing agent was 4.5 kg/t, by means of which the sulfur content was reduced to 0.009 weight %. This corresponded to a desulfurization degree of 86%.

(b) In a comparative test, use was made of a prior art mixture consisting of 85 weight % commercial carbide ($CaC_2$ content 78% by weight) and 15 weight % $CaCO_3$. The submersion depth and injection rate were as in Example 3(a), but 6.0 kg/t were required to be used to obtain the same degree of desulfurization, for an identical initial sulfur content.

As compared with the prior desulfurizing agent used in this comparative test the desulfurizing mixture of this invention permitted a 25% economy, based on the absolute quantity of desulfurizing mixture, and a 45% economy, based on the $CaC_2$ content, to be achieved. The treatment time was also reduced at the same rate.

We claim:

1. A mixture for the desulfurization of steel and crude iron melts comprising (a) a $CaC_2/CaO$-crystalline blend containing 40 to 80 weight % CaO and having crystallized out of a fused mass of CaO and $CaC_2$, (b) 1 to 6 weight % of chemically combined water having hydrated CaO in the $CaC_2/CaO$-crystalline blend to form $Ca(OH)_2$;

(c) 0.5 to 8 weight % free carbon; and (d) 0.5 to 20 weight % carbonates of a substance selected from calcium, magnesium and sodium.

2. The mixture of claim 1 comprising 2.5 to 3.5 weight % of chemically combined water.

3. The mixture of claim 1 having been prepared by introducing finely divided calcium oxide in an excess of 3 to 15 weight %, based on the quantity desired in the $CaC_2/CaO$-crystalline blend, into a calcium carbide melt which already has up to 45 weight % calcium oxide contained in it; cooling the mixture to temperatures of 350° to 450° C. to effect solidification; rough-crushing the solidified mixture at these temperatures to particles with a size of less than 150 mm; separating invariably obtained particles with a size smaller than 4 mm from coarser material; admixing the latter with free carbon and carbonate, and comminuting the mixture in the presence of a substance selected from air and nitrogen with a moisture content of 5 to 20 g/m$^3$, calculated for 1.013 bar and 273.15 K., by crushing and grinding at temperatures lower than 100° C. to particles with a size of less than 10 mm.

4. A process for the manufacture of a mixture as claimed in claim 1, which comprises introducing finely divided calcium oxide in an excess of 3 to 15 weight %, based on the quantity desired in the $CaC_2/CaO$-crystalline blend, into a calcium carbide melt which already has up to 45 weight % calcium oxide contained in it; cooling the mixture to temperatures of 350° to 450° C. to effect solidification; rough-crushing the solidified mixture at these temperatures to particles with a size of less than 150 mm; separating invariably obtained particles with a size smaller than 4 mm from coarser material; admixing the latter with free carbon and carbonate, and comminuting the mixture in the presence of a substance selected from air and nitrogen with a moisture content of 5 to 20 g/m$^3$ (at 1.013 bar and 273.15 K.) by crushing and grinding at temperatures lower than 100° C. to particles with a size of less than 10 mm.

5. Process as claimed in claim 4, wherein the calcium oxide which is to be added to the calcium carbide melt is pre-heated to temperatures of up to 2000° C. and is introduced into the melt while hot, the calcium oxide being pre-heated to temperatures which are the higher, the higher the proportion of additionally dissolved calcium oxide desired, within the range 40 to 80 weight %.

6. Process as claimed in claim 4, wherein a calcium carbide melt containing 20 to 45 weight % calcium oxide is used.

7. Process as claimed in claim 4, wherein the fraction of particles with a size smaller than 4 mm sieved off after the rough-crushing step, is recycled into the process.

8. Process as claimed in claim 4, wherein the mixture is comminuted at temperatures of 10° to 50° C. to particles with a size of less than 10 mm.

9. Process as claimed in claim 4, wherein the mixture is comminuted to particles with a size of less than 0.1 mm.

* * * * *